United States Patent [19]

Wolbrink

[11] 4,136,606

[45] Jan. 30, 1979

[54] WALL MOUNTED VENTILATING DEVICE

[75] Inventor: David W. Wolbrink, Hartford, Wis.

[73] Assignee: Broan Manufacturing Co., Inc., Hartford, Wis.

[21] Appl. No.: 781,108

[22] Filed: Mar. 25, 1977

[51] Int. Cl.[2] ..... F24F 7/06

[52] U.S. Cl. ..... 98/33 A; 98/108

[58] Field of Search ..... 98/33 A, 40 N, 108, 98/36, 39; 236/49; 237/46

[56] References Cited

U.S. PATENT DOCUMENTS

| | | | |
|---|---|---|---|
| 2,182,690 | 12/1939 | Cole | 98/39 |
| 2,800,069 | 7/1957 | Smith | 98/108 |
| 3,332,334 | 7/1967 | Melzer | 98/36 |
| 3,347,025 | 10/1967 | Wiley | 98/33 R X |
| 3,572,234 | 3/1971 | Schoenthaler | 98/36 |

*Primary Examiner*—William E. Wayner

*Attorney, Agent, or Firm*—Andrus, Sceales, Starke & Sawall

[57] ABSTRACT

A room ventilating device has an elongated duct mountable on or in the wall. The duct extends from near the ceiling to a blower mounted adjacent the floor. The blower draws hot air from along the ceiling down the duct. The blower is so formed and constructed as to project the hot air well into the room in a laminar flow thereby to induce a highly effective temperature equalizing air circulation in the room with the consumption of small amounts of energy.

15 Claims, 5 Drawing Figures

WALL MOUNTED VENTILATING DEVICE

BACKGROUND OF THE INVENTION

1. Field of the Invention

The present invention relates to ventilating devices for buildings.

2. Description of the Prior Art

Buildings are commonly heated by heating the air in the rooms and other occupied portions. As is well known, heating reduces the density of air. This causes the heated air to rise and stagnate along the ceiling of the room while cold air remains on the floor. Temperature differences of 15° F to 30° F may exist between the floor and the ceiling. Such stratification occurs not only in radiant heating systems, such as those employing hot water, but also with hot air systems during the intervals in which the blower is off. Because of the stratification, additional heat must be supplied to the room to make the occupied area adjacent the floor comfortable.

To overcome the thermally induced stratification and stagnation, it has been proposed to position a duct in the room extending from the ceiling to the floor. A fan coupled to the duct draws the hot air adjacent the ceiling down the duct and discharges it onto the floor, thereby reducing the temperature difference between the ceiling and floor and increasing the temperature of the occupied area adjacent the latter. See for example, U.S. Pat. No. 1,170,551 to Marty and U.S. Pat. No. 3,173,353 to Watkins which show devices of this type.

While devices of this type shown in the aforesaid patents increase the comfort in the room, it is readily apparent that little consideration has been directed to their efficiencies. Given the present high cost of energy, such prior art devices would well consume more energy than might be saved through the more uniform heating of the room.

SUMMARY OF THE PRESENT INVENTION

It is, therefore, the object of the present invention to provide a ventilating device of the type described above having greatly improved efficiency so as to insure low energy consumption in its use.

More specifically, and in contrast to such prior art devices as that shown in U.S. Pat. No. 3,173,353, the present invention employs an axial flow fan to impart desired velocities to the air at minimal energy consumption. The axial flow fan is employed in conjunction with an optimized discharge port structure arrayed along the axis of the fan which provides maximum "throw" to the discharged air, thereby to maximize the efficiency of the stratification reduction. Such optimization includes the use of an axial plenum between the fan and the discharge port for reducing air turbulence resulting from passage through the fan. The sides of the discharge port structure downstream of the plenum converge to enhance the velocity properties of the air. Louvers in the discharge port provide a highly efficient laminar flow to the discharged air.

The air velocity and flow properties of the present invention extend the projection of the heated, ceiling air well into the room. This results in a rising column of air, spaced from the ventilating device which breaks through the layer of cold air adjacent the floor. The rising air stream starts the surrounding air in motion and a gentle air movement gradually spreads throughout the entire room. The result is the induction of a flow of air in the room which establishes and maintains a comfortable heat distribution with minimal power consumption. It has been found that the ventilating device of the present invention holds floor and ceiling temperatures within 5° to 10° F of each other.

DETAILED DESCRIPTION OF THE PREFERRED EMBODIMENT

Figure 1:
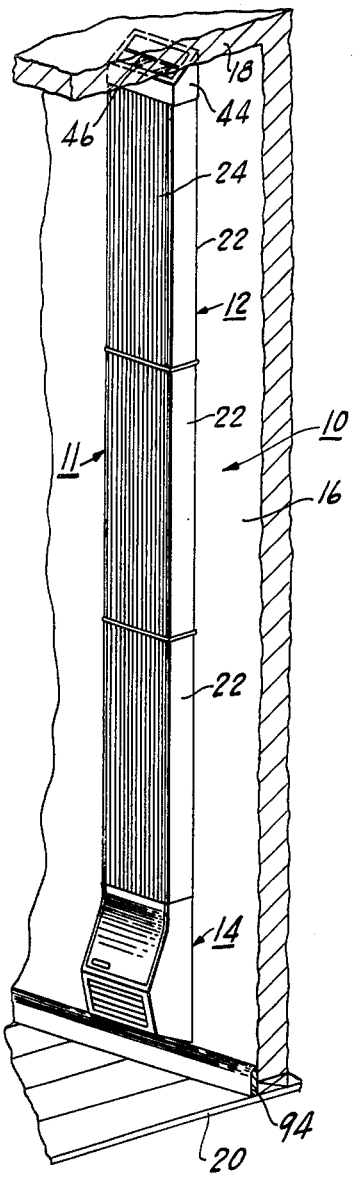
FIG. 1 is a perspective view of the improved ventilating device of the present invention.

Ventilating device 10 of the present invention comprises two major elements, duct 12 and blower 14.

Duct 12 is fastened to wall 16 to extend from adjacent ceiling 18 to blower 14 mounted near floor 20. To facilitate the handling of duct 12, and its packaging for sale, it is deemed preferable to form the duct in a plurality of sections. Three such sections, 22 are shown in the Figures. The front side of each of the sections which faces outwardly when duct 12 is mounted on the wall may contain decorative grooves 24. The rear side which is against the wall contains recess 26. The sections are joined together by connectors 28, shown in detail in FIG. 4, which are interposed between abutting ends of the sections.

Figure 4:
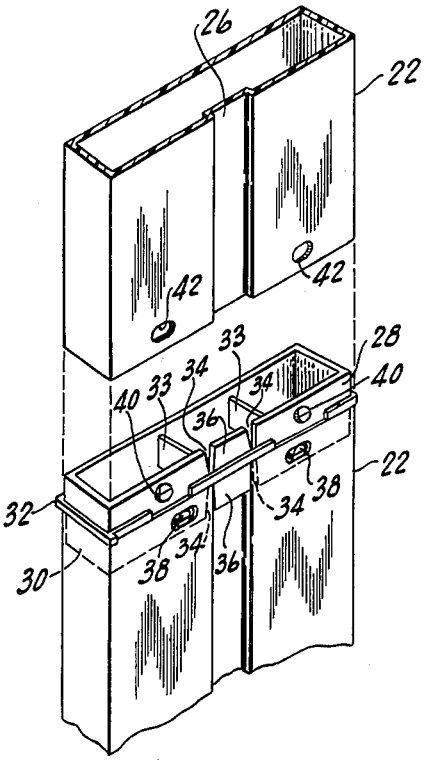
FIG. 4 is a partial perspective view of the rear side of the duct portion of the ventilating device showing the means for fastening the portions of the duct together.

Connector 28 includes a peripheral wall 30, sized to fit inside duct sections 22. Medial rib 32 extends around wall 30 to divide the wall generally into upper and lower parts which fit, respectively, into the duct beneath and the duct above connector 28. Transverse stiffening webs 33 may be provided between walls 30. The rear portion of wall 30 contains slots 34 which define tabs 36. The rear portion of wall 30 also includes two groups of laterally spaces bosses 38 and 40, one of which groups is located on each of the upper and lower parts of wall 30. Bosses 38 and bosses 40 are shifted out of alignment in the direction normal to rib 30, as shown in FIG. 4.

In use, connector 28 is slid into the upper end of the duct section 22 which will be beneath connector 28 so that wall 30 is inside the duct section, except for tab 36 which lies outside the wall in groove 26. Bosses 38 extend through corresponding holes 42 in the rear wall of duct section 22. Connector 28 is then slid into the lower end of the adjoining section 22 so that wall 30 similarly lies inside duct 12 with tab 36 in groove 26. Bosses 40 are inserted in corresponding holes 42 in the rear wall of upper duct section 22 so as to retain the two sections together.

The upper end of duct 11 assembled from duct sections 22 is provided with an air inlet 44. Air inlet 44 contains ribs 46, see FIG. 1, which stiffen the inlet, and contains hole 48 which facilitates fastening ventilating device 10 to the wall in the manner hereinafter described.

Figure 3:
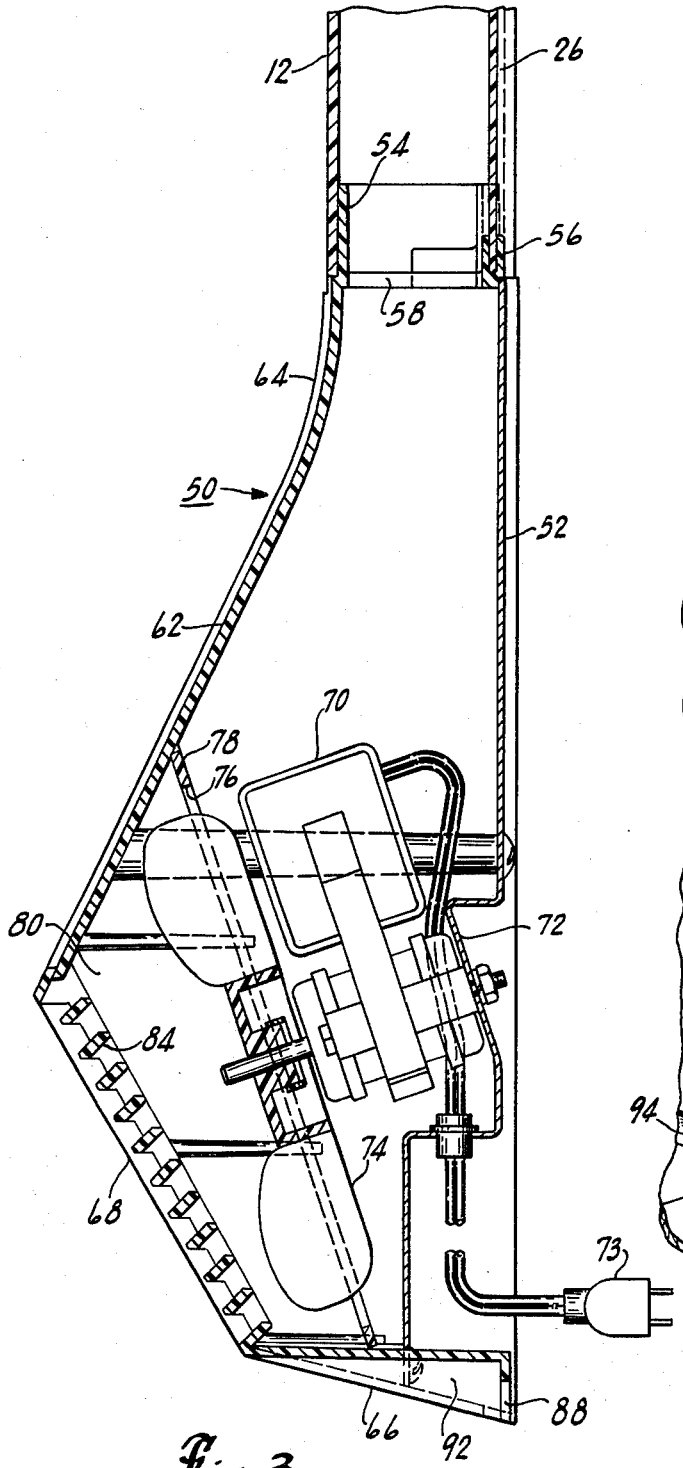
FIG. 3 is a cross sectional view of the blower portion of the ventilating device of the present invention taken along the line 3—3 of FIG. 2.

Blower 14 is mounted on the lower end of duct 12. Blower 14 includes housing 50 closed by back plate 52, as shown in FIG. 3. The upper end of housing 50 contains collar 54 which is insertable in the lower end of duct 12. A slotted portion 56 in the rear of collar 54 accommodates groove 26 in the rear wall of duct section 22. Screen 58 prevents harmful objects from entering housing 50 and causing damage to the blower.

Front wall 62 of blower housing 50 is angularly displaced with respect to the front side of duct 12 as shown in FIG. 3, by arcuate section 64. Front wall 62 joins slanted bottom wall 66 to form a discharge port 68 for blower housing 50.

Motor 70 is mounted on back plate 52. An angled portion 72 may be provided in back plate 52 so as to position motor 70 in front of discharge port 68. Motor 70 may be any of the commonly available single phase types, such as a shaded pole motor. Motor 70 is energized by means of power cord 73.

In accordance with the invention, fan 74 of the axial flow type is mounted on the output shaft of motor 70 to draw air down duct 12 and discharge it with increased velocity in a highly efficient manner. Fan 74 extends through the venturi 76 of venturi plate 78 which serves to increase the effectiveness of fan 74. Venturi plate 78 is mounted in housing 50 to form the rear wall of a plenum 80 located axially downstream of fan 74 to receive the discharge of fan 74 and to permit a reduction in its turbulence. Port 68 forms the front of plenum 80 so that the entire area of part 68 may receive the discharge from the plenum. As shown most clearly in FIG. 2 side walls 82 of blower housing 50 and plenum 80 taper in a direction which converges toward the front of blower 14, thereby to enhance the velocity properties of the air discharged from fan 74. At present, it is deemed preferable to taper side walls 82 by 6°; that is, each side wall converges at an angle of 6° to a plane normal to building wall 16.

Louvers 84 extend across port 68 to control both the manner and direction in which the air in plenum 80 enters the room. Specifically, louvers 84 insure that the discharge of air into the room is laminar in nature. They further direct the air slightly downwardly so that air of quantity and velocity required to reduce stratification can enter the room without a draft being felt by the occupants. At present, it is deemed preferable to orient louvers 84 at an angle of 45°, as shown in FIG. 3. If the louvers were more horizontal, a draft about the occupant's knees might result. If the louvers were more perpendicular, the discharge would be directed more forcibly against the floor, resulting in a turbulent air flow across the floor. The effectiveness of the air flow would also be lost due to the roughness of a carpet type floor covering on floor 26.

Figure 2:
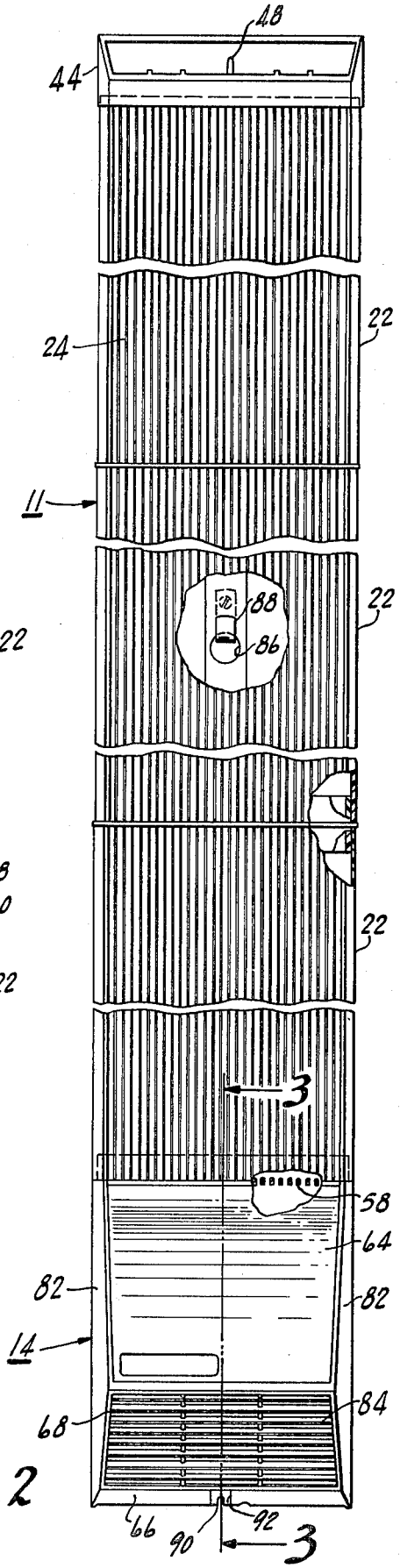
FIG. 2 is a front view of the ventilating device with portions thereof broken away to reveal certain details.

Ventilating device 10 is assembled by joining duct section 22 together with connectors 28, as described above. Inlet 44 is placed at the top of duct 12. Blower 14 is placed at the bottom of duct 12. Ventilating device 10 is then hung on wall 16. For this purpose, a hole 86 is provided in one of duct sections 22 which receives hanger 88 affixed to wall 16, as shown in FIG. 2. Screws inserted in hole 48 in inlet 44 and slot 90 at the bottom of blower housing 50 assist in retaining ventilating device 10 on wall 16. Bottom wall 66 of blower housing 50 may be provided with indentation 92 to provide a vertical surface for slot 90. At present it is deemed preferable to position ventilating device 10 so that inlet 44 is within eight inches of the ceiling and the bottom of blower 14 is just above the base board 94 on wall 16.

Motor 70 is energized. Hot air along ceiling 18 is drawn through inlet 44 down duct 12 and discharged from outlet 68 adjacent floor 20, thereby reducing the temperature difference between the ceiling and floor. More specifically, by means of the optimized features of blower 14, ventilating device 10 projects the discharged hot air with sufficient velocity and to sufficient distance into the room to facilitate breaking up the stagnation while, at the same time, avoiding drafts along the floor.

The power consumption of motor 68 is so low that the motor may continue to run throughout the heating season.

Figure 5:
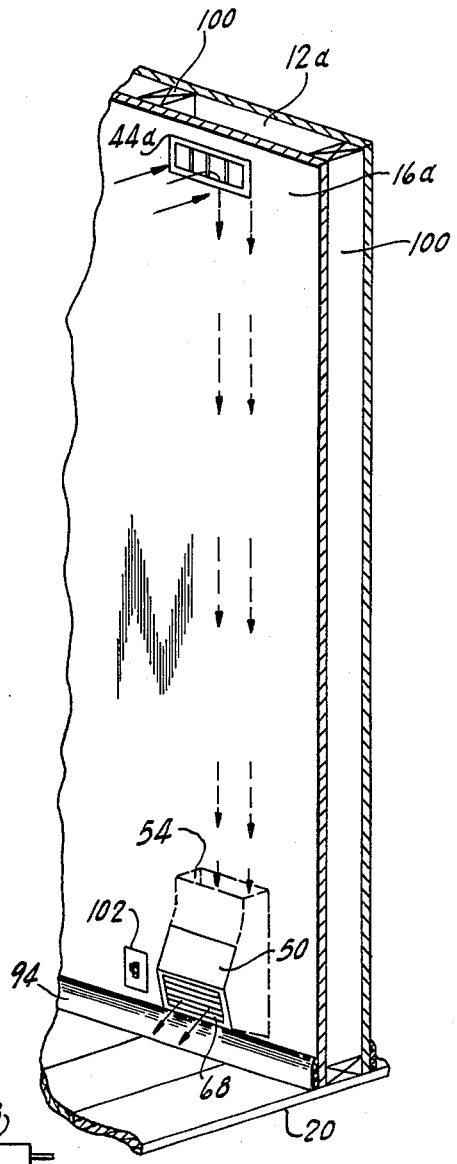
FIG. 5 is a perspective view of an alternative embodiment of the ventilating device of the present invention.

FIG. 5 shows an alternative embodiment of the ventilating device of the present invention in which the device is built-in. It is possible simply to embed ventilating device 10 in the wall so that inlet 44 and discharge port 68 are exposed. It is also possible to use the chamber formed in the wall by the studs as a duct. As shown in FIG. 5, inlet **44*a* is inserted through the plaster of wall 16*a* between studs 100 to form duct 12*a* in the wall. Blower 14 may be identical to blower 14 shown in FIGS. 1 through 4 having collar 54 opening into chamber 12*a* and housing 50 extending through wall 16*a* so that discharge port 68 opens into the room. Switch 102 controls the operation of the motor in housing 50**.

Various modes of carrying out the invention are contemplated as being within the scope of the following claims particularly pointing out and distinctly claiming the subject matter which is regarded as the invention.

I claim:

1. A ventilating device for a room having a ceiling, floor, and wall, said room having a stratum of hot air along the ceiling, said ventilating device comprising:

an elongated duct extending in a generally vertical direction and mountable on the wall, said duct having vertical front and back walls joined by a pair of spaced side walls, said duct having an upper end positionable near the ceiling and a lower end; and a blower mounted on the lower end of said duct adjacent the floor of the room, said blower including a housing having side walls, a front wall, and a back wall forming extensions of the corresponding walls of said duct, the upper portion of said front wall of said housing diverging in its downward extension out of alignment with said vertical front wall and away from the plane of the back wall of said duct, the portion of said front wall immediately below said upper portion converging in its downward extension toward the plane of the back wall of said duct to present a surface orientatable toward the floor of the room when the duct is mounted on the wall of the room, a fan of the axial flow type mounted in said housing for drawing hot air down the duct and for imparting an increased velocity thereto, a plenum located axially in front of said fan and between said side walls of said housing for receiving the air from said fan, said plenum having a port in said converging portion of said front wall of said housing for discharging said air from said plenum into the room angularly downward toward the floor, said discharge port having means to project the discharged air into the room in a laminar flow.

2. The ventilating device according to claim 1 wherein said fan is so mounted in said housing as to discharge air at a downwardly directed angle with respect to the vertical plane of said back wall of said duct.

3. The ventilating device according to claim 2 wherein the axis of said fan lies at a greater angle with respect to the vertical plane of said back wall of said duct than does a line normal to the plane of said converging portion of said front wall.

4. The ventilating device according to claim 1 wherein said side walls converge in the direction of air discharge of said plenum for enhancing velocity characteristics of the air.

5. The ventilating device according to claim 4 wherein the convergence of each of said side walls is 6° with respect to a vertical plane normal to said wall.

6. The ventilating device according to claim 4 wherein said discharge port contains louvers positioned at a predetermined angle to provide the desired projection of air into the room.

7. The ventilating device according to claim 6 wherein said louvers in said discharge port are oriented at an angle of 45° with respect to the vertical plane of the back wall of said duct.

8. The ventilating device according to claim 1 wherein said plenum is formed by a venturi plate having a venturi through which said fan extends.

9. The ventilating device according to claim 1 wherein said port extends entirely across said front wall between said side walls.

10. The ventilating device according to claim 1 wherein said elongated duct is formed of a plurality of duct sections joined by connectors.

11. The ventilating device according to claim 10 wherein each of said connectors has a wall fitting inside contiguous sections of said duct, said connector wall having a plurality of bosses, said ducts having mating holes adjacent the ends for receiving said bosses when said duct sections are moved into contiguity for retaining said sections together.

12. The ventilating device according to claim 11 wherein said bosses and holes are located in the back wall of said duct facing the wall on which said duct is mounted.

13. The ventilating device according to claim 1 wherein said duct has a back wall facing the wall when said duct is mounted on the wall, said back wall containing an elongated groove and wherein said connector wall includes a tab suitable for positioning on the exterior of said duct in said groove.

14. The ventilating device according to claim 1 wherein said duct is mounted on the wall of the room.

15. The ventilating device according to claim 14 including means for mounting said ventilating device on the wall.

* * * * *